US010047613B2

(12) United States Patent
Ford et al.

(10) Patent No.: US 10,047,613 B2
(45) Date of Patent: Aug. 14, 2018

(54) GAS TURBINE COMPONENTS HAVING NON-UNIFORMLY APPLIED COATING AND METHODS OF ASSEMBLING THE SAME

(71) Applicant: General Electric Company, Schenectady, NY (US)

(72) Inventors: Cody Jermaine Ford, Simpsonville, SC (US); Brad Wilson VanTassel, Easley, SC (US)

(73) Assignee: General Electric Company, Schenectady, NY (US)

( * ) Notice: Subject to any disclaimer, the term of this patent is extended or adjusted under 35 U.S.C. 154(b) by 323 days.

(21) Appl. No.: 14/841,056

(22) Filed: Aug. 31, 2015

(65) Prior Publication Data

US 2017/0058682 A1 Mar. 2, 2017

(51) Int. Cl.
*F01D 5/28* (2006.01)
*F01D 9/04* (2006.01)

(52) U.S. Cl.
CPC ..... *F01D 5/288* (2013.01); *F01D 9/041* (2013.01); *F05D 2220/32* (2013.01); *F05D 2230/60* (2013.01); *F05D 2230/90* (2013.01); *F05D 2240/12* (2013.01); *F05D 2240/122* (2013.01); *F05D 2240/123* (2013.01); *F05D 2240/129* (2013.01); *F05D 2240/30* (2013.01); *F05D 2240/305* (2013.01); *F05D 2260/231* (2013.01); *F05D 2300/611* (2013.01)

(58) Field of Classification Search
CPC ..... F01D 9/041; F01D 5/288; F01D 5/286; F01D 25/007; F05D 2230/90; F05D 2300/611; F05D 2240/123; F05D 2260/95
USPC ..... 416/224, 241 R, 241 B
See application file for complete search history.

(56) References Cited

U.S. PATENT DOCUMENTS 5,209,645 A * 5/1993 Kojima ..... C23C 4/02 416/224
5,645,399 A 7/1997 Angus
6,095,755 A * 8/2000 Houston ..... F01D 5/288 416/224
6,106,231 A * 8/2000 Brainch ..... F01D 5/20 29/527.2
6,126,400 A * 10/2000 Nichols ..... F01D 5/288 415/177

(Continued)

FOREIGN PATENT DOCUMENTS

EP 1 013 883 A2 6/2000
EP 2 325 441 A2 5/2011
WO 2014/095758 A1 6/2014

OTHER PUBLICATIONS

Extended European Search Report and Opinion issued in connection with corresponding EP Application No. 16183749.7 dated Jan. 30, 2017.

*Primary Examiner* — Ninh H Nguyen
*Assistant Examiner* — Topaz L Elliott
(74) *Attorney, Agent, or Firm* — Armstrong Teasdale LLP

(57) ABSTRACT

A gas turbine component is provided. The gas turbine component includes an airfoil having a leading edge, a trailing edge, a suction side extending from the leading edge to the trailing edge, and a pressure side extending from the leading edge to the trailing edge opposite the suction side. The gas turbine component also includes a thermal barrier coating applied to the airfoil pressure side such that an uncoated margin is defined on the pressure side at the trailing edge.

20 Claims, 7 Drawing Sheets

(56) References Cited

U.S. PATENT DOCUMENTS

| | | | | |
|---|---|---|---|---|
| 6,254,756 | B1 * | 7/2001 | Maricocchi | C23C 10/58 205/122 |
| 6,274,215 | B1 * | 8/2001 | Brainch | B23P 6/005 156/297 |
| 6,667,114 | B2 | 12/2003 | Grylls et al. | |
| 7,008,178 | B2 * | 3/2006 | Busch | F01D 5/189 415/115 |
| 7,008,186 | B2 | 3/2006 | Heeg et al. | |
| RE39,320 | E | 10/2006 | Nichols et al. | |
| 7,186,070 | B2 | 3/2007 | Morris et al. | |
| 7,422,417 | B2 | 9/2008 | Landis | |
| 7,491,033 | B2 * | 2/2009 | Trishkin | F01D 5/18 29/889.721 |
| 7,922,455 | B2 | 4/2011 | Itzel et al. | |
| 8,070,454 | B1 | 12/2011 | Rawlings | |
| 8,157,515 | B2 * | 4/2012 | Bailey | B23P 6/002 415/202 |
| 8,197,184 | B2 * | 6/2012 | Chon | F01D 5/185 415/115 |
| 8,317,473 | B1 | 11/2012 | Liang | |
| 8,511,993 | B2 | 8/2013 | Kemppainen et al. | |
| 8,708,658 | B2 * | 4/2014 | Milleville | C23C 30/00 416/241 R |
| 8,827,632 | B1 | 9/2014 | Lee et al. | |
| 9,719,371 | B2 * | 8/2017 | Hannam | F01D 5/288 |
| 2007/0148003 | A1 | 6/2007 | Trishkin et al. | |
| 2008/0085191 | A1 | 4/2008 | Liang | |
| 2011/0116912 | A1 * | 5/2011 | McCall | C23C 14/042 415/177 |
| 2013/0121839 | A1 | 5/2013 | Batt et al. | |
| 2015/0017018 | A1 | 1/2015 | Lacy et al. | |
| 2016/0108742 | A1 * | 4/2016 | Papple | F01D 5/288 416/95 |
| 2016/0265384 | A1 * | 9/2016 | Walston | F01D 25/12 |

* cited by examiner

GAS TURBINE COMPONENTS HAVING NON-UNIFORMLY APPLIED COATING AND METHODS OF ASSEMBLING THE SAME

BACKGROUND

The field of this disclosure relates generally to gas turbine components and, more particularly, to a thermal barrier coating for use with a gas turbine component.

At least some known gas turbine assemblies include a compressor, a combustor, and a turbine. Gases flow into the compressor and are compressed. The compressed gases are then discharged into the combustor, mixed with fuel, and ignited to generate combustion gases. The combustion gases are channeled from the combustor through the turbine, thereby driving the turbine which, in turn, may power an electrical generator coupled to the turbine.

Known gas turbine components (e.g., turbine stator components) may be susceptible to deformation and/or fracture during higher-temperature operating cycles. To reduce the effects of exposure to higher temperatures, it is known to apply a thermal barrier coating to at least some known gas turbine components, thereby improving the useful life of the components. However, the thermal barrier coating can alter the geometry of the components, which can adversely affect the overall operating efficiency of the gas turbine assembly. As such, the usefulness of such coatings may be limited.

BRIEF DESCRIPTION

In one aspect, a gas turbine component is provided. The gas turbine component includes an airfoil having a leading edge, a trailing edge, a suction side extending from the leading edge to the trailing edge, and a pressure side extending from the leading edge to the trailing edge opposite the suction side. The gas turbine component also includes a thermal barrier coating applied to the airfoil pressure side such that an uncoated margin is defined on the pressure side at the trailing edge.

In another aspect, a method of assembling a gas turbine component is provided. The method includes providing an airfoil having a leading edge, a trailing edge, a suction side extending from the leading edge to the trailing edge, and a pressure side extending from the leading edge to the trailing edge opposite the suction side. The method also includes applying a thermal barrier coating to the airfoil such that the thermal barrier coating is on the pressure side of the airfoil and such that an uncoated margin is defined on the pressure side at the trailing edge.

In another aspect, a gas turbine component is provided. The gas turbine component includes a first airfoil having a first leading edge, a first trailing edge, a first suction side extending from the first leading edge to the first trailing edge, and a first pressure side extending from the first leading edge to the first trailing edge opposite the first suction side. The gas turbine component also includes a second airfoil having a second leading edge, a second trailing edge, a second suction side extending from the second leading edge to the second trailing edge, and a second pressure side extending from the second leading edge to the second trailing edge opposite the second suction side. The gas turbine component further includes a thermal barrier coating applied to the second pressure side of the second airfoil. The thermal barrier coating is not applied to the first pressure side of the first airfoil.

DETAILED DESCRIPTION

The following detailed description illustrates gas turbine components and methods of assembling the same by way of example and not by way of limitation. The description should enable one of ordinary skill in the art to make and use the components, and the description describes several embodiments of the components, including what is presently believed to be the best modes of making and using the components. An exemplary component is described herein as being coupled within a gas turbine assembly. However, it is contemplated that the component has general application to a broad range of systems in a variety of fields other than gas turbine assemblies.

Figure 1:
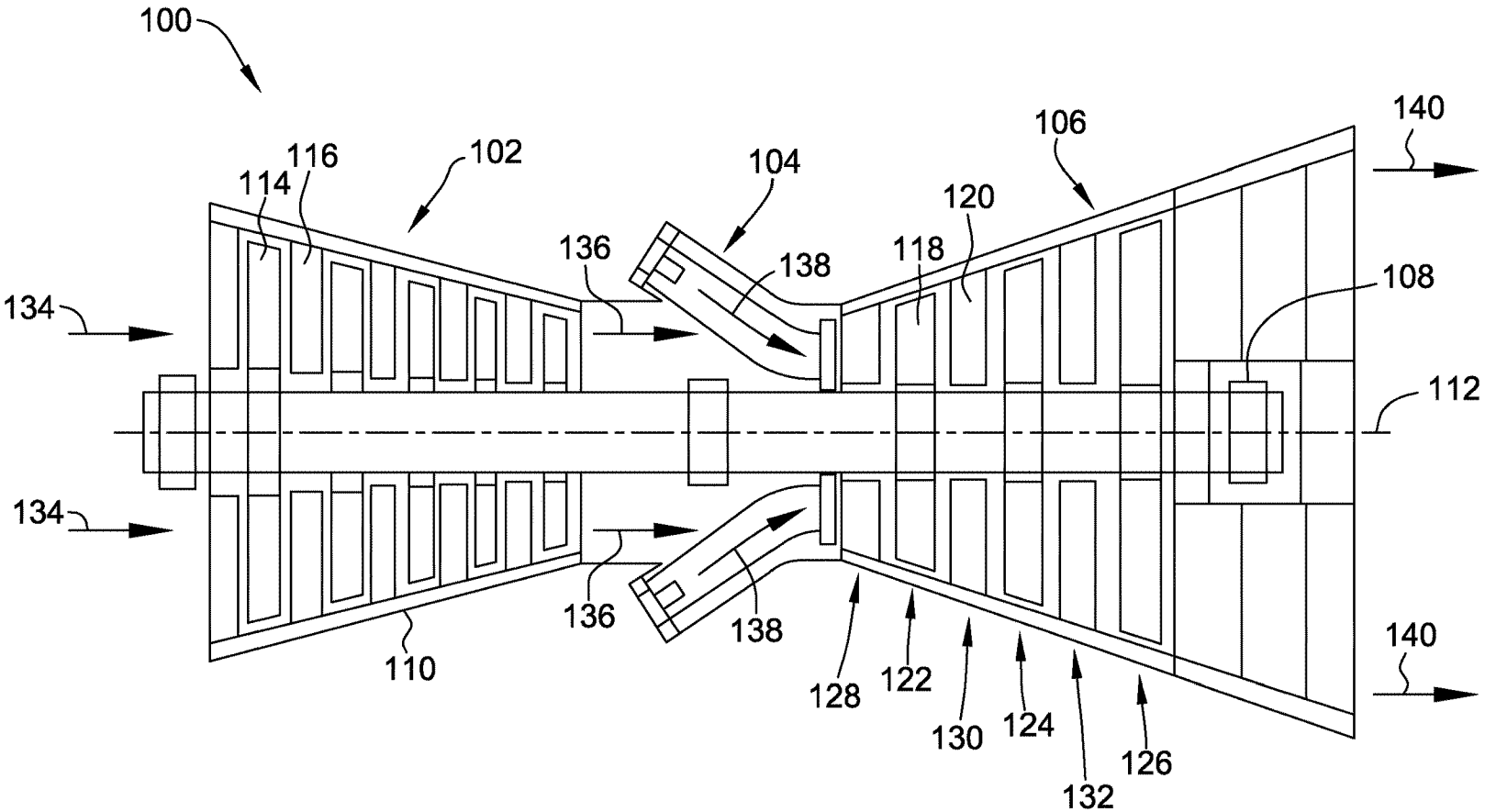
FIG. 1 is a schematic view of an exemplary gas turbine assembly.

FIG. 1 illustrates an exemplary gas turbine assembly 100. In the exemplary embodiment, gas turbine assembly 100 has a compressor 102, a combustor 104, and a turbine 106 coupled in flow communication with one another within a casing 110 and spaced along a centerline axis 112. Compressor 102 includes a plurality of rotor blades 114 and a plurality of stator vanes 116, and turbine 106 likewise includes a plurality of rotor blades 118 and a plurality of stator vanes 120. Notably, turbine rotor blades 118 (or buckets) are grouped in a plurality of annular, axially-spaced stages (e.g., a first rotor stage 122, a second rotor stage 124, and a third rotor stage 126) that are rotatable in unison via an axially-aligned rotor shaft 108. Similarly, stator vanes 120 (or nozzles) are grouped in a plurality of annular, axially-spaced stages (e.g., a first stator stage 128, a second stator stage 130, and a third stator stage 132) that are axially-interspaced with rotor stages 122, 124, and 126. As such, first rotor stage 122 is spaced axially between first and second stator stages 128 and 130 respectively, second rotor stage 124 is spaced axially between second and third stator stages 130 and 132 respectively, and third rotor stage 126 is spaced downstream from third stator stage 132.

In operation, working gases 134 (e.g., ambient air) flow into compressor 102 and are compressed and channeled into combustor 104. Compressed gases 136 are mixed with fuel and ignited in combustor 104 to generate combustion gases 138 that are channeled into turbine 106. In an axially-sequential manner, combustion gases 138 flow through first stator stage 128, first rotor stage 122, second stator stage 130, second rotor stage 124, third stator stage 132, and third rotor stage 126 interacting with rotor blades 118 to drive rotor shaft 108 which may, in turn, drive an electrical generator (not shown) coupled to rotor shaft 108. Combustion gases 138 are then discharged from turbine 106 as exhaust gases 140.

Figure 2:
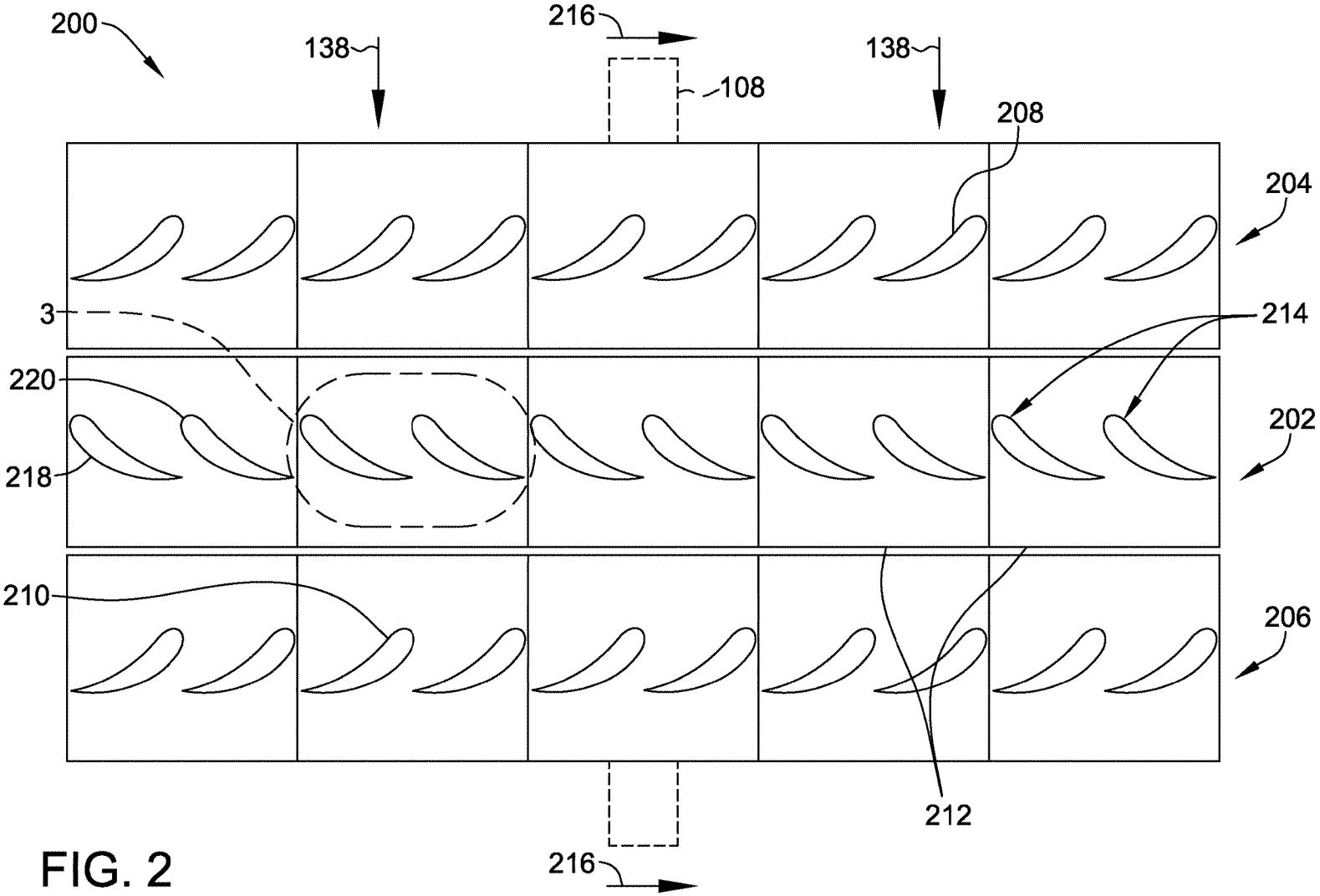
FIG. 2 is a diagram of an exemplary section of the gas turbine assembly shown in FIG. 1.
Figure 3:
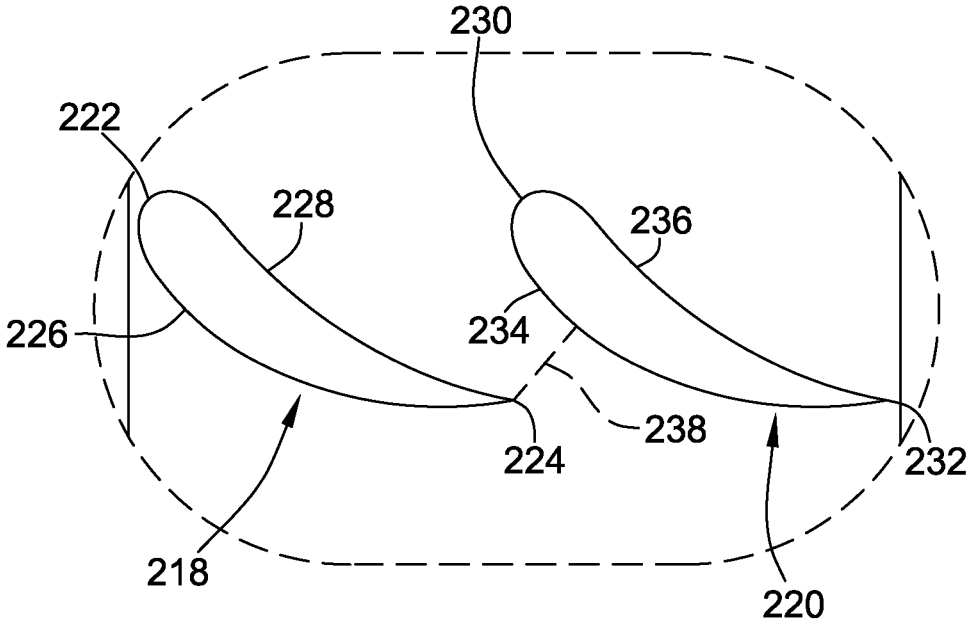
FIG. 3 is an enlarged portion of the diagram shown in FIG. 2 taken within area 3.
Figure 4:
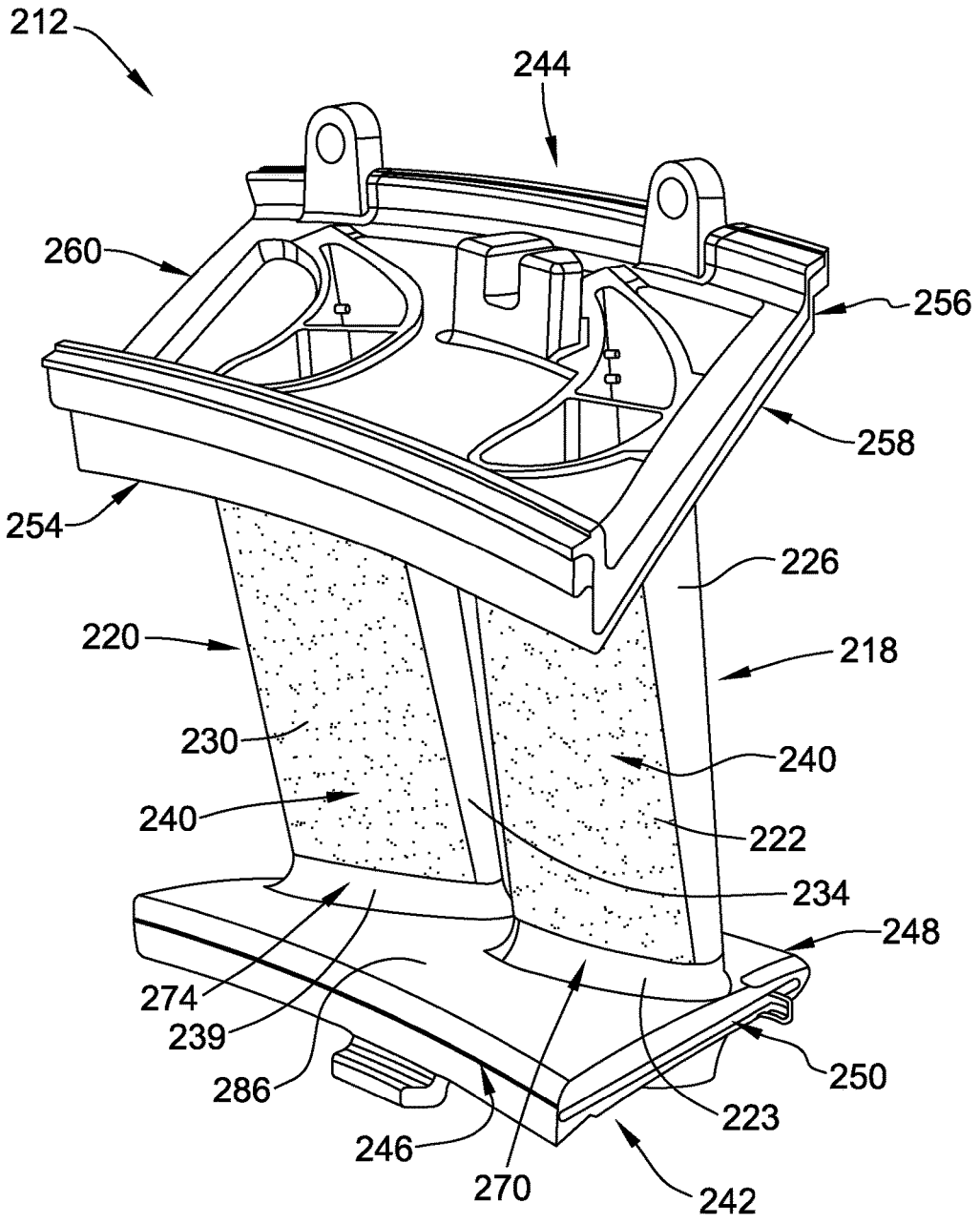
FIG. 4 is a perspective view of an exemplary stator vane segment of the section shown in FIG. 2.
Figure 5:
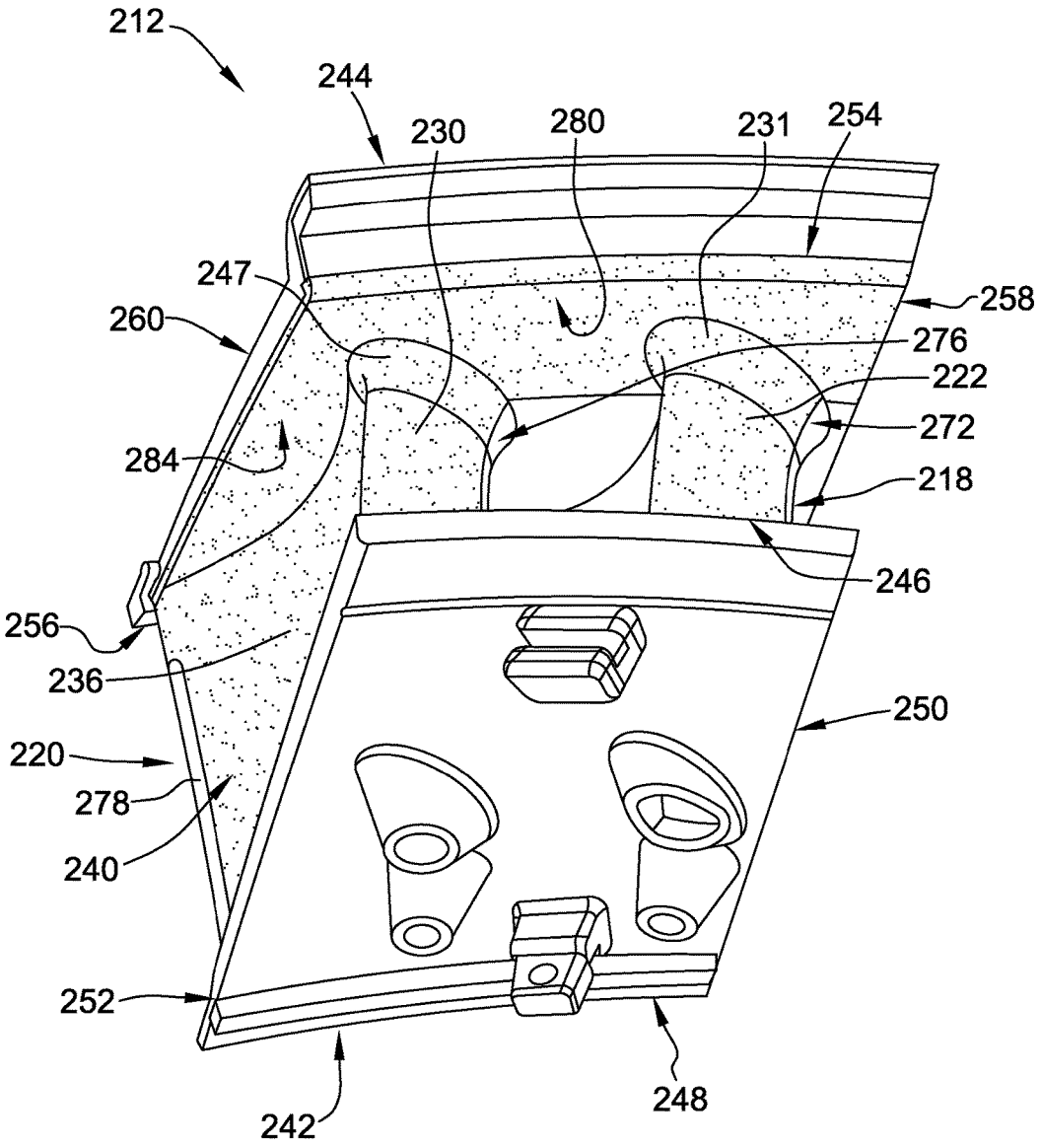
FIG. 5 is another perspective view of the stator vane segment shown in FIG. 4.
Figure 6:
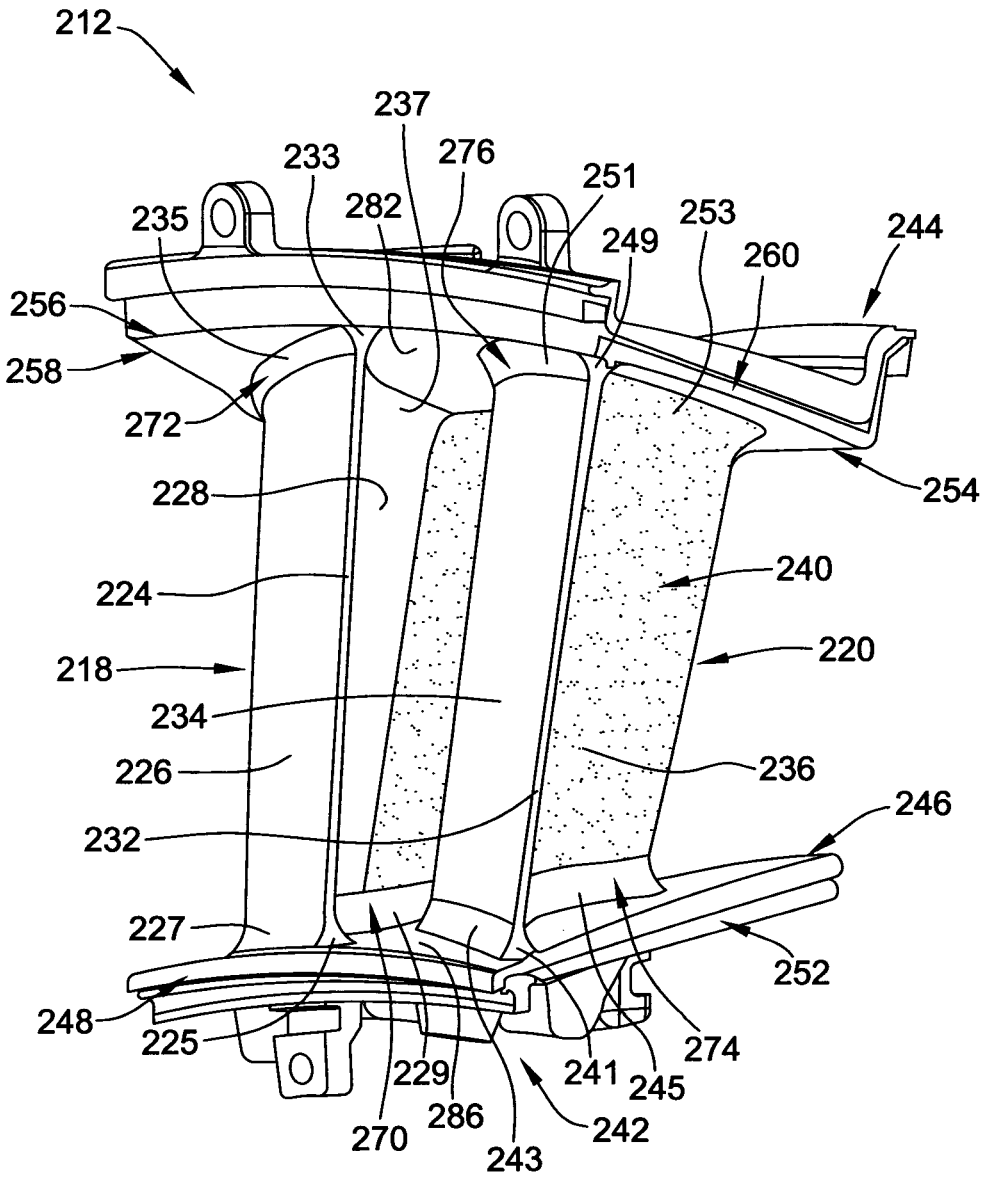
FIG. 6 is yet another perspective view of the stator vane segment shown in FIG. 4.
Figure 7:
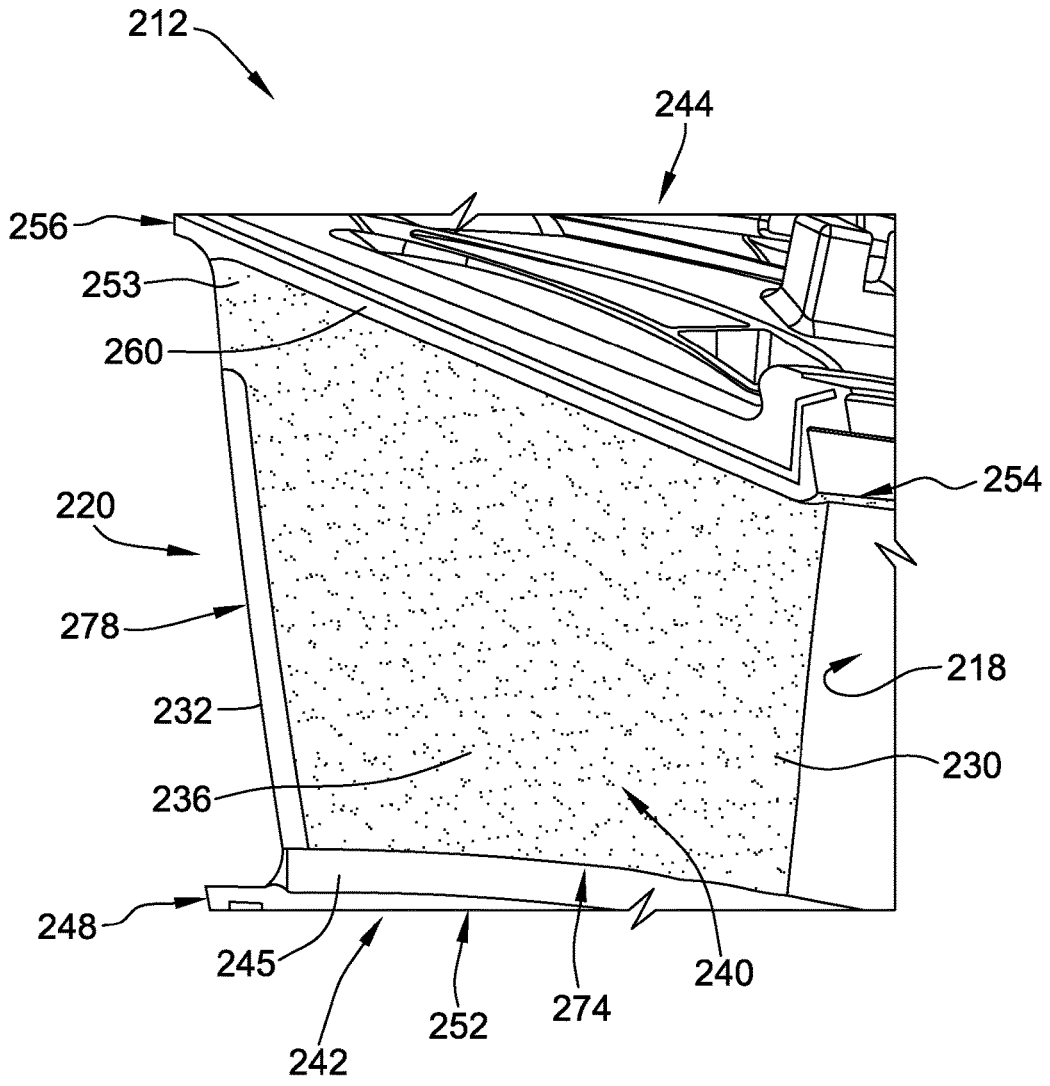
FIG. 7 is a further perspective view of the stator vane segment shown in FIG. 4.

FIG. 2 is a diagram of an exemplary section 200 of gas turbine assembly 100, and FIG. 3 is an enlarged section of the diagram shown in FIG. 2 taken within area 3. In the exemplary embodiment, section 200 includes a stator stage 202 (such as, for example, second stator stage 130) spaced axially between an upstream rotor stage 204 (such as, for example, first rotor stage 122) and a downstream rotor stage 206 (such as, for example, second rotor stage 124). Upstream rotor stage 204 has an annular arrangement of circumferentially-spaced, airfoil-shaped rotor blades 208, and downstream rotor stage 206 has an annular arrangement of circumferentially-spaced, airfoil-shaped rotor blades 210. Notably, upstream rotor stage 204 and downstream rotor stage 206 of section 200 are coupled to, and are rotatable with, rotor shaft 108 about centerline axis 112 of gas turbine assembly 100.

Stator stage 202 includes a plurality of stator vane segments 212 that are coupled together in an annular formation. In the exemplary embodiment, each segment 212 includes a pair of stator vanes 214 (commonly referred to as a "doublet"). In other embodiments, each segment 212 may instead have only one stator vane 214 (commonly referred to as a "singlet"), may have three stator vanes 214 (commonly referred to as a "triplet"), or may have four stator vanes 214 (commonly referred to as a "quadruplet"). Alternatively, stator stage 202 may have any suitable number segments 212, and/or stator vanes 214 per segment 212, that enables section 200 to function as described herein.

During operation of gas turbine assembly 100 with section 200 used in turbine 106, combustion gases 138 discharged from combustor 104 are channeled through upstream rotor stage 204, stator stage 202, and into downstream rotor stage 206. As such, combustion gases 138 drive rotor stages 204 and 206 in a rotational direction 216 relative to stator stage 202 such that each rotor blade 210 of downstream rotor stage 206 may experience a vibratory stimulus as it passes each corresponding stator vane 214 (or segment 212). For example, if stator stage 202 is provided with forty-eight stator vanes 214, each rotor blade 210 of downstream rotor stage 206 may experience forty-eight vibratory stimulus events per revolution. Alternatively, the frequency of vibratory stimulus may be related to the quantity of segments 212 (e.g., the stator stage 202 may have twenty-four segments 212, each being a doublet, which may yield twenty-four stimulus events per revolution). In some operating cycles of gas turbine assembly 100, the frequency of the vibratory stimulus events may coincide with the resonant frequency of rotor blades 210, which may in turn render rotor blades 210 more susceptible to failure (e.g., fracture and/or deformation) if the magnitude of the vibratory stimulus exceeds a predetermined threshold. Hence, it is desirable to reduce the magnitude of each vibratory stimulus imparted to each rotor blade 210.

In the exemplary embodiment, stator vanes 214 of each segment 212 are airfoil-shaped and are fixed side-by-side in the manner of a first stator vane 218 and a second stator vane 220. Each first stator vane 218 has a first leading edge 222, a first trailing edge 224, a first suction side 226, and a first pressure side 228. Similarly, each second stator vane 220 has a second leading edge 230, a second trailing edge 232, a second suction side 234, and a second pressure side 236. Notably, the minimum area between adjacent stator vanes 218 and 220 (e.g., as measured at the associated trailing edge 224 or 232) is a parameter commonly referred to as a "throat" 238 of that turbine stage 202. Collectively, throats 238 of stator stage 202 define the mass flow of combustion gases 138 through stator stage 202, and hence the size of each throat 238 is a parameter that can significantly affect the overall operating efficiency of gas turbine assembly 100.

FIGS. 4-7 are each perspective views of an exemplary segment 212 with a thermal barrier coating 240 applied thereto. In the exemplary embodiment, each segment 212 (e.g., first stator vane 218 and second stator vane 220) is fabricated from a suitable metal or alloy of metals, so as to have an ideal range of operating temperatures within which structural integrity is facilitated to be maintained. However, it may be desirable in some instances to operate gas turbine assembly 100 in a manner that may expose segments 212 to temperatures above the upper limit of their ideal range of operating temperatures. Because long term exposure to such elevated temperatures can have an undesirable effect on the structural integrity of segments 212 (e.g., because segments 212 can experience low cycle fatigue and creep-related cracking at such temperatures), in the exemplary embodiment, thermal barrier coating 240 is applied to one or more segments 212 (e.g., to one or both vanes 218 and 220 of each segment 212) in an effort to reduce the likelihood that segments 212 will experience low cycle fatigue and creep-related cracking at higher temperatures. Optionally, in the manner set forth herein, thermal barrier coating 240 may also be applied to rotor blades 208 and/or 210 in other embodiments.

In some instances, however, thermal barrier coating 240 may be thick enough to undesirably alter the geometry of segment(s) 212 in a manner that reduces the mass flow of combustion gases 138 through stator stage 202 by, for example, decreasing the cross-sectional flow area of throats 238. This could, in turn, increase the vibratory stimulus imparted to rotor blades 210 to a magnitude that is above a predetermined threshold, which could make rotor blades 210 more susceptible to failure. It is therefore desirable to apply thermal barrier coating 240 to segment(s) 212 in a manner that facilitates segment(s) 212 withstanding higher temperatures, while also minimizing associated increases in the magnitude of the vibratory stimulus imparted to rotor blades 210.

In the exemplary embodiment, first and second stator vanes 218 and 220 each extend between a radially inner sidewall 242 and a radially outer sidewall 244. Inner sidewall 242 has a forward edge 246, an aft edge 248, a first side edge 250 adjacent to first stator vane 218, and a second side edge 252 adjacent to second stator vane 220. Similarly, outer sidewall 244 has a forward edge 254, an aft edge 256, a first side edge 258 adjacent to first stator vane 218, and a second side edge 260 adjacent to second stator vane 220. In other embodiments, inner sidewall 242 and/or outer sidewall 244 may have any suitable configurations that enable segment 212 functioning as described herein.

First stator vane 218 has a first inner fillet 270 and a first outer fillet 272 at which first stator vane 218 is coupled to inner sidewall 242 and outer sidewall 244, respectively. Similarly, second stator vane 220 has a second inner fillet 274 and a second outer fillet 276 at which second stator vane 220 is coupled to inner sidewall 242 and outer sidewall 244, respectively. As such, in the exemplary embodiment, first leading edge 222, first trailing edge 224, first suction side 226, and first pressure side 228 each have an inner fillet region 223, 225, 227 and 229, respectively, and an outer fillet region 231, 233, 235 and 237, respectively. Likewise, second leading edge 230, second trailing edge 232, second suction side 234, and second pressure side 236 each have an inner fillet region 239, 241, 243, and 245, respectively, and an outer fillet region 247, 249, 251 and 253, respectively. In other embodiments, stator vanes 218 and 220 may be coupled to sidewalls 242 and 244 in any suitable manner that enables vanes 218 and 220 to function as described herein.

Notably, in the exemplary embodiment, thermal barrier coating 240 is an integrally-formed, single-piece structure that is not applied uniformly across the entire segment 212

(e.g., thermal barrier coating 240 may be applied to at least one surface of second stator vane 220, but not to the analogous surface(s) of first stator vane 218, and/or thermal barrier coating 240 may be applied to at least one surface of outer sidewall 244, but not to the analogous surface(s) of inner sidewall 242). Rather, in the exemplary embodiment, thermal barrier coating 240 is selectively applied to only those surfaces of segment 212 at which stresses are likely to concentrate when segment 212 is exposed to higher-temperature operating conditions. For example, in the exemplary embodiment, with respect to first stator vane 218, thermal barrier coating 240 is applied only to first leading edge 222, such that first leading edge 222 is entirely covered except for its inner fillet region 223. Notably, in such an embodiment, thermal barrier coating 240 is not applied to first trailing edge 224, first suction side 226, and/or first pressure side 228. In other embodiments, thermal barrier coating 240 may be applied to first stator vane 218 in any suitable manner that enables segment 212 to function as described herein.

With respect to second stator vane 220, thermal barrier coating 240 is applied only to second leading edge 230 and second pressure side 236, such that second leading edge 230 and second pressure side 236 are entirely covered except for: (A) their inner fillet regions 239 and 245, respectively; and (B) a margin 278 defined on second pressure side 236 at second trailing edge 232 that extends from inner fillet region 245 of second pressure side 236 towards outer fillet region 253 of second pressure side 236. More specifically, in the exemplary embodiment, margin 278 extends from about four-fifths to about nine-tenths of the way to outer fillet region 253 of second pressure side 236 from inner fillet region 245 of second pressure side 236. Notably, thermal barrier coating 240 is not applied to second suction side 234 and second trailing edge 232. In other embodiments, thermal barrier coating 240 may be applied to second stator vane 220 in any suitable manner that enables segment 212 to function as described herein.

With respect to outer sidewall 244, thermal barrier coating 240 is applied only to: (A) a forward region 280 of its radially inner surface 282 (e.g., thermal barrier coating 240 may be confined to the forwardmost one-fifth, one-fourth, or one-third of radially inner surface 282); and (B) a first side region 284 of its radially inner surface between 282 (e.g., thermal barrier coating 240 may completely cover radially inner surface 282 from second pressure side 236 to second side edge 260). Notably, thermal barrier coating 240 is not applied to the radially outer surface 286 of inner sidewall 242. In other embodiments, thermal barrier coating 240 may be applied to inner sidewall 242 and/or outer sidewall 244 in any suitable manner that enables segment 212 to function as described herein (e.g., thermal barrier coating 240 may be applied to radially outer surface 286 of inner sidewall 242 but not to radially inner surface 282 of outer sidewall 244 in one embodiment, or thermal barrier coating 240 may be applied to both radially outer surface 286 of inner sidewall 242 and radially inner surface 282 of outer sidewall 244 in another embodiment).

During operation of gas turbine assembly 100, when all, or at least some, of segments 212 of stator stage 202 are coated with thermal barrier coating 240 as described herein, stator stage 202 is more apt to withstand temperatures above the upper limit of its ideal range of operating temperatures. Moreover, the size of throats 238 remains substantially unchanged as compared to segments 212 to which no thermal barrier coating 240 has been applied, because pressure sides 228 and 236 are substantially uncoated at their corresponding trailing edges 224 and 232 (except near outer fillet region 253 of second pressure side 236 at second trailing edge 232). As such, undesirably high vibratory stimuli imparted on rotor blades 210 of downstream rotor stage 206 are facilitated to be minimized.

The methods and systems described herein facilitate enabling increases to engine firing temperatures of a turbine assembly by selectively coating turbine stator components, such as, but not limited to, the second stage turbine nozzle, with a thermal barrier coating in a manner that facilitates reducing their operating temperatures and increasing their useful life. The methods and systems also provide for leaving turbine stator components substantially uncoated in areas that define a nozzle throat. Thus, the methods and systems facilitate reducing harmonic stimulus to, and potential harmonic resonance of, downstream turbine rotor components. The methods and systems thereby facilitate reducing the likelihood of high cycle fatigue failure of the downstream turbine rotor components. The methods and systems further facilitate not altering or otherwise adversely affecting the durability and/or overall operating efficiency of an already-fabricated and/or already-operational gas turbine assembly when applying a thermal barrier coating to its turbine components. More specifically, the methods and systems facilitate retrofitting existing turbine componentry with a thermal barrier coating without adversely altering the durability and/or overall operating efficiency of the gas turbine assembly.

Exemplary embodiments of gas turbine components and methods of assembling the same are described above in detail. The methods and systems described herein are not limited to the specific embodiments described herein, but rather, components of the methods and systems may be utilized independently and separately from other components described herein. For example, the methods and systems described herein may have other applications not limited to practice with gas turbine assemblies, as described herein. Rather, the methods and systems described herein can be implemented and utilized in connection with various other industries.

While the invention has been described in terms of various specific embodiments, those skilled in the art will recognize that the invention can be practiced with modification within the spirit and scope of the claims.

What is claimed is:

1. A gas turbine component comprising:

an airfoil comprising a leading edge, a trailing edge, a suction side extending from said leading edge to said trailing edge, and a pressure side extending from said leading edge to said trailing edge opposite said suction side, wherein said suction side and said pressure side each comprise an inner fillet region and an outer fillet region; and a thermal barrier coating applied such that said airfoil suction side is uncoated, said airfoil pressure side inner fillet region is uncoated, said airfoil pressure side trailing edge is uncoated from said inner fillet region outwardly to a location along a span of said airfoil, and a remainder of said airfoil pressure side including said airfoil pressure side outer fillet region is coated.

2. A gas turbine component in accordance with claim 1, wherein said thermal barrier coating is applied across said airfoil leading edge.

3. A gas turbine component in accordance with claim 1, wherein said component comprises an inner sidewall and an outer sidewall such that said airfoil extends from said inner sidewall to said outer sidewall, said thermal barrier coating applied to at least one of said inner sidewall and said outer sidewall.

4. A gas turbine component in accordance with claim 3, wherein said thermal barrier coating is applied to said inner sidewall and is not applied to said outer sidewall.

5. A gas turbine component in accordance with claim 3, wherein said thermal barrier coating is applied to said outer sidewall and is not applied to said inner sidewall.

6. A gas turbine component in accordance with claim 1, wherein said airfoil pressure side trailing edge is uncoated from said inner fillet region outwardly to about four-fifths to about nine-tenths of said span of said airfoil.

7. A method of assembling a gas turbine component, said method comprising:

providing an airfoil having a leading edge, a trailing edge, a suction side extending from the leading edge to the trailing edge, and a pressure side extending from the leading edge to the trailing edge opposite the suction side, wherein the suction side and the pressure side each include an inner fillet region and an outer fillet region, and wherein the airfoil pressure side inner fillet region extends from the leading edge to the trailing edge; and applying to the airfoil a thermal barrier coating such that the airfoil pressure side inner fillet region is uncoated, the airfoil pressure side trailing edge is uncoated from the inner fillet region outwardly to a location along a span of the airfoil, and a remainder of the airfoil pressure side including the airfoil pressure side outer fillet region is coated.

8. A method in accordance with claim 7, further comprising applying the thermal barrier coating to the airfoil such that the thermal barrier coating extends across the airfoil leading edge.

9. A method in accordance with claim 8, further comprising applying the thermal barrier coating to the airfoil such that the thermal barrier coating is not on the airfoil suction side.

10. A method in accordance with claim 7, further comprising coupling the airfoil between an inner sidewall and an outer sidewall.

11. A method in accordance with claim 10, further comprising applying the thermal barrier coating to the outer sidewall.

12. A gas turbine component comprising:

a first airfoil comprising a first leading edge, a first trailing edge, a first suction side extending from said first leading edge to said first trailing edge, and a first pressure side extending from said first leading edge to said first trailing edge opposite said first suction side, wherein said first suction side and said first pressure side each comprise a first inner fillet region and a first outer fillet region;

a second airfoil comprising a second leading edge, a second trailing edge, a second suction side extending from said second leading edge to said second trailing edge, and a second pressure side extending from said second leading edge to said second trailing edge opposite said second suction side, wherein said second suction side and said second pressure side each comprise a second inner fillet region and a second outer fillet region; and a thermal barrier coating applied such that:

said first airfoil pressure side inner fillet region is uncoated, said first airfoil trailing edge is uncoated, and said first airfoil leading edge is coated; and said second airfoil pressure side inner fillet region is uncoated, said second airfoil pressure side trailing edge is uncoated from said second inner fillet region outwardly to a location along a span of said second airfoil, and a remainder of said second airfoil pressure side including said second outer fillet region is coated.

13. A gas turbine component in accordance with claim 12, wherein said second airfoil pressure side trailing edge is uncoated from said second inner fillet region outwardly to about four-fifths to about nine-tenths of said span of said second airfoil.

14. A gas turbine component in accordance with claim 12, wherein said thermal barrier coating is applied across said second leading edge of said second airfoil.

15. A gas turbine component in accordance with claim 14, wherein said thermal barrier coating is not applied to said first suction side of said first airfoil or said second suction side of said second airfoil.

16. A gas turbine component in accordance with claim 12, further comprising an inner sidewall and an outer sidewall, wherein said airfoils are coupled between said sidewalls.

17. A gas turbine component in accordance with claim 16, wherein said thermal barrier coating is applied to said outer sidewall.

18. A gas turbine component in accordance with claim 17, wherein said outer sidewall comprises a side edge adjacent said second airfoil, said thermal barrier coating applied between said second pressure side and said side edge.

19. A gas turbine component in accordance with claim 17, wherein said thermal barrier coating is not applied to said inner sidewall.

20. A gas turbine component in accordance with claim 16, wherein said airfoils are stator vanes.

* * * * *